US006890668B2

(12) United States Patent
Bruce et al.

(10) Patent No.: US 6,890,668 B2
(45) Date of Patent: May 10, 2005

(54) THERMAL BARRIER COATING MATERIAL

(75) Inventors: Robert William Bruce, Loveland, OH (US); Glen Alfred Slack, Scotia, NY (US)

(73) Assignee: General Electric Company, Schenectady, NY (US)

( * ) Notice: Subject to any disclaimer, the term of this patent is extended or adjusted under 35 U.S.C. 154(b) by 110 days.

(21) Appl. No.: 10/064,939

(22) Filed: Aug. 30, 2002

(65) Prior Publication Data

US 2004/0043244 A1 Mar. 4, 2004

(51) Int. Cl.[7] ..... B32B 15/01; F03B 3/12

(52) U.S. Cl. ..... 428/632; 428/633; 428/701; 428/702; 428/699; 416/241 B

(58) Field of Search ..... 428/633, 632, 428/469, 701, 702, 699, 698; 416/241 B

(56) References Cited

U.S. PATENT DOCUMENTS

| | | | | |
|---|---|---|---|---|
| 4,535,033 A | * | 8/1985 | Stecura | |
| 4,774,150 A | | 9/1988 | Amano et al. | 415/173.4 X |
| 5,512,382 A | | 4/1996 | Strangman | 428/632 |
| 5,562,998 A | | 10/1996 | Strangman | 428/612 |
| 5,624,721 A | | 4/1997 | Strangman | 427/255.28 X |
| 5,643,474 A | | 7/1997 | Sangeeta | 216/96 |
| 5,871,820 A | | 2/1999 | Hasz et al. | 427/419.2 |
| 6,025,078 A | | 2/2000 | Rickerby et al. | 428/469 |
| 6,117,560 A | | 9/2000 | Maloney | 428/472 |
| 6,127,006 A | * | 10/2000 | Schulz et al. | |
| 6,284,323 B1 | * | 9/2001 | Maloney | |
| 6,333,118 B1 | * | 12/2001 | Alperine et al. | |
| 6,352,788 B1 | | 3/2002 | Bruce | 428/633 |
| 6,387,539 B1 | * | 5/2002 | Subramanian | |
| 6,586,115 B2 | * | 7/2003 | Rigney et al. | |

OTHER PUBLICATIONS

U.S. patent application Ser. No. 10/064,758, Darolia et al., filed Aug. 16, 2002.

* cited by examiner

*Primary Examiner*—Jennifer McNeil
(74) *Attorney, Agent, or Firm*—David L. Narciso; Gary M. Hartman; Domenica N. S. Hartman

(57) ABSTRACT

A coating material for a component intended for use in a hostile thermal environment. The coating material has a cubic microstructure and consists essentially of either zirconia stabilized by dysprosia, erbia, gadolinium oxide, neodymia, samarium oxide or ytterbia, or hafnia stabilized by dysprosia, gadolinium oxide, samarium oxide, yttria or ytterbia. Up to five weight percent yttria may be added to the coating material.

23 Claims, 1 Drawing Sheet

THERMAL BARRIER COATING MATERIAL

BACKGROUND OF INVENTION

1. Field of the Invention

This invention generally relates to coatings for components exposed to high temperatures, such as the hostile thermal environment of a gas turbine engine. More particularly, this invention is directed to a protective coating for a thermal barrier coating (TBC) on a gas turbine engine component, in which the protective coating has a low thermal conductivity, and may be resistant to infiltration by contaminants present in the operating environment of a gas turbine engine.

2. Description of the Related Art

Higher operating temperatures for gas turbine engines are continuously sought in order to increase their efficiency. However, as operating temperatures increase, the high temperature durability of the components within the hot gas path of the engine must correspondingly increase. Significant advances in high temperature capabilities have been achieved through the formulation of nickel and cobalt-base superalloys. Nonetheless, certain components of the turbine, combustor and augmentor sections of a gas turbine engine can be required to operate at temperatures at which the mechanical properties of such alloys are insufficient. For this reason, these components are often protected by a thermal barrier coating (TBC).

TBC's are typically formed of ceramic materials deposited by plasma spraying, flame spraying and physical vapor deposition (PVD) techniques. TBC's employed in the highest temperature regions of gas turbine engines are most often deposited by PVD, particularly electron-beam PVD (EBPVD), which yields a strain-tolerant columnar grain structure that is able to expand and contract without causing damaging stresses that lead to spallation. Similar columnar microstructures can be produced using other atomic and molecular vapor processes, such as sputtering (e.g., high and low pressure, standard or collimated plume), ion plasma deposition, and all forms of melting and evaporation deposition processes (e.g., cathodic arc, laser melting, etc.). In contrast, plasma spraying techniques such as air plasma spraying (APS) deposit TBC material in the form of molten splats, resulting in a TBC characterized by a degree of inhomogeneity and porosity.

Various ceramic materials have been proposed as TBC's, the most notable of which is zirconia ($ZrO_2$) that is partially or fully stabilized by yttria ($Y_2O_3$) magnesia (MgO) or another alkaline-earth metal oxides, or ceria ($CeO_2$) or another rare-earth metal oxides to yield a tetragonal microstructure that resists phase changes. Still other stabilizers have been proposed for zirconia, including hafnia ($HfO_2$) (U.S. Pat. No. 5,643,474 to Sangeeta) and gadolinia (gadolinium oxide; $Gd_2O_3$) (U.S. Pat. No. 6,177,200 to Maloney). U.S. Pat. Nos. 5,512,382 and 5,624,721 to Strangman mention yttria-stabilized hafnia as a possible TBC material, though neither of these patents suggests what a suitable composition or microstructure might be. Still other proposed TBC materials include ceramic materials with the pyrochlore structure $A_2B_2O_7$, where A is lanthanum, gadolinium or yttrium and B is zirconium, hafnium and titanium (U.S. Pat. No. 6,117,560 to Maloney). However, yttria-stabilized zirconia (YSZ) has been the most widely used TBC material. Reasons for this preference for YSZ are believed to include its high temperature capability, low thermal conductivity, and relative ease of deposition by plasma spraying, flame spraying and PVD techniques.

To protect a gas turbine engine component from its hostile thermal environment, the thermal conductivity of a TBC is of considerable importance. Lower thermal conductivities enable the use of a thinner coating, reducing the weight of the component, and/or reduce the amount of cooling airflow required for air-cooled components such as turbine blades. Though the thermal conductivity of YSZ decreases with increasing yttria content, the conventional practice has been to partially stabilize zirconia with six to eight weight percent yttria (6–8% YSZ) to promote spallation resistance. Ternary YSZ systems have been proposed to reduce the thermal conductivity of YSZ. For example, commonly-assigned U.S. Pat. No. 6,586,115 to Rigney et al. discloses a TBC of YSZ and alloyed to contain certain amounts of one or more alkaline-earth metal oxides (magnesia, calcia (CaO), strontia (SrO) and barium oxide (BaO)), rare-earth metal oxides (ceria, gadolinium oxide, lanthana ($La_2O_3$), neodymia ($Nd_2O_3$), and dysprosia ($Dy_2O_3$)), and/or such metal oxides as nickel oxide (NiO), ferric oxide ($Fe_2O_3$), cobaltous oxide (CoO), and scandium oxide ($Sc_2O_3$). According to Rigney et al.; when present in sufficient amounts these oxides are able to significantly reduce the thermal conductivity of YSZ by increasing crystallographic defects and/or lattice strains. Another proposed ternary system based on YSZ and said to reduce thermal conductivity is taught in U.S. Pat. No. 6,025,078 to Rickerby et al. The additive oxide is gadolinium oxide, dysprosia, erbia ($Er_2O_3$), europia ($Eu_2O_3$) praseodymia ($Pr_2O_3$), urania ($UO_2$) or ytterbia ($Yb_2O_3$), in an amount of at least five weight percent to reduce phonon thermal conductivity.

Additions of oxides to YSZ coating systems have also been proposed for purposes other than lower thermal conductivity. For example, U.S. Pat. No. 4,774,150 to Amano et al. discloses that bismuth oxide ($Bi_2O_3$), titania ($TiO_2$), terbia ($Tb_4O_7$), europia and/or samarium oxide ($Sm_2O_3$) may be added to certain layers of a YSZ TBC for the purpose of serving as luminous activators.

To protect a gas turbine engine component from its hostile thermal environment, the thermal conductivity of a TBC is of considerable importance. Lower thermal conductivities enable the use of a thinner coating, reducing the weight of the component, and/or reduce the amount of cooling airflow required for air-cooled components such as turbine blades. Though the thermal conductivity of YSZ decreases with increasing yttria content, the conventional practice has been to partially stabilize zirconia with six to eight weight percent yttria (6–8% YSZ) to promote spallation resistance. Ternary YSZ systems have been proposed to reduce the thermal conductivity of YSZ. For example, commonly-assigned U.S. Pat. No. 6,586,115 to Rigney et al. discloses a TBC of YSZ and alloyed to contain certain amounts of one or more alkaline-earth metal oxides (magnesia, calcia (GaO), strontia (SrO) and barium oxide (BaO)), rare-earth metal oxides (ceria, gadolinium oxide, lanthana ($La_2O_3$), neodymia ($Nd_2O_3$), and dysprosia ($Dy_2O_3$)), and/or such metal oxides as nickel oxide (NiO), ferric oxide ($Fe_2O_3$), cobaltous oxide (CoO), and scandium oxide ($Sc_2O_3$). According to Rigney et al., when present in sufficient amounts these oxides are able to significantly reduce the thermal conductivity of YSZ by increasing crystallographic defects and/or lattice strains. Another proposed ternary system based on YSZ and said to reduce thermal conductivity is taught in U.S. Pat. No. 6,025,078 to Rickerby et al. The additive oxide is gadolinium oxide, dysprosia, erbia ($Er_2O_3$), europia ($Eu_2O_3$), praseodymia ($Pr_2O_3$), urania ($U\mathbf{0}_2$) or ytterbia ($Yb_2O_3$), in an amount of at least five weight percent to reduce phonon thermal conductivity.

The service life of a TBC system is typically limited by a spallation event brought on by thermal fatigue. In addition to the CTE mismatch between a ceramic TBC and a metallic substrate, spallation can be promoted as a result of the TBC being contaminated with compounds found within a gas turbine engine during its operation. A notable example is a mixture of several different compounds, typically calcia, magnesia, alumina and silica, referred to herein as CMAS. CMAS has a relatively low melting eutectic (about 1190° C.) that when molten is able to infiltrate to the cooler subsurface regions of a TBC, where it resolidifies. During thermal cycling, the CTE mismatch between CMAS and the TBC promotes spallation, particularly TBC deposited by PVD and APS due to the ability of the molten CMAS to penetrate their columnar and porous grain structures, respectively.

It would be desirable if improved TBC materials were available that exhibited low thermal conductivities, and preferably also exhibited resistance to spallation attributable to CMAS infiltration.

SUMMARY OF INVENTION

The present invention generally provides a coating material, particularly a thermal barrier coating (TBC), for a component intended for use in a hostile thermal environment, such as the superalloy turbine, combustor and augmentor components of a gas turbine engine. The coating material has a cubic microstructure and consists essentially of either zirconia ($ZrO_2$) stabilized by dysprosia ($Dy_2O_3$), gadolinium oxide ($Gd_2O_3$), erbia ($Er_2O_3$), neodymia ($Nd_2O_3$), samarium oxide ($Sm_2O_3$) or ytterbia ($Yb_2O_3$), or hafnia ($HfO_2$) stabilized by dysprosia, gadolinium oxide, samarium oxide, yttria or ytterbia. Up to five weight percent yttria may be added to the coating materials to further promote thermal cycle fatigue life.

According to the invention, zirconia and hafnia alloyed with their respective above-noted stabilizers have been shown to have lower thermal conductivities than conventional 6–8% YSZ, allowing for the use of a thinner coating and/or lower cooling airflow for air-cooled components. In addition, the hafnia-based coatings of this invention are resistant to infiltration by CMAS, thereby promoting the life of the TBC by reducing the risk of CMAS-induced spallation. While others have proposed additions of some of the oxides used as stabilizers in the present invention, including the aforementioned U.S. Pat. No. 6,586,115 to Rigney et al., U.S. Pat. No. 6,025,078 to Rickerby et al., U.S. Pat. No. 6,117,560 to Maloney and U.S. Pat. No. 4,774,150 to Amano et al., such prior uses were based on additional oxides present in limited regions of a TBC (Amano et al.), or oxides added to the binary YSZ system in which zirconia is stabilized by yttria to yield a tetragonal microstructure (Rigney et al. and Rickerby et al.) or a cubic pyrochlore microstructure (Maloney) which therefore differ from the cubic (fluorite-type) microstructures of the present invention.

The coatings of this invention can be readily deposited by PVD to have a strain-resistant columnar grain structure, which reduces the thermal conductivity and promotes the strain tolerance of the coating. Alternatively, the coatings can be deposited by plasma spraying to have microstructures characterized by splat-shaped grains.

According to the invention, zirconia and hafhia alloyed with their respective above-noted stabilizers have been shown to have lower thermal conductivities than conventional 6–8% YSZ, allowing for the use of a thinner coating and/or lower cooling airflow for air-cooled components. In addition, the hafnia-based coatings of this invention are resistant to infiltration by CMAS, thereby promoting the life of the TBC by reducing the risk of CMAS-induced spallation. While others have proposed additions of some of the oxides used as stabilizers in the present invention, including the aforementioned U.S. Pat. No. 6,586,115 to Rigney et al., U.S. Pat. No. 6,025,078 to Rickerby et al., U.S. Pat. No. 6,117,560 to Maloney and U.S. Pat. No. 4,774,150 to Amano et al., such prior uses were based on additional oxides present in limited regions of a TBC (Amano et al.), or oxides added to the binary YSZ system in which zirconia is stabilized by yttria to yield a tetragonal microstructure (Rigney et al. and Rickerby et al.) or a cubic pyrochlore microstructure (Maloney) which therefore differ from the cubic (fluorite-type) microstructures of the present invention.

DETAILED DESCRIPTION

Figure 1:
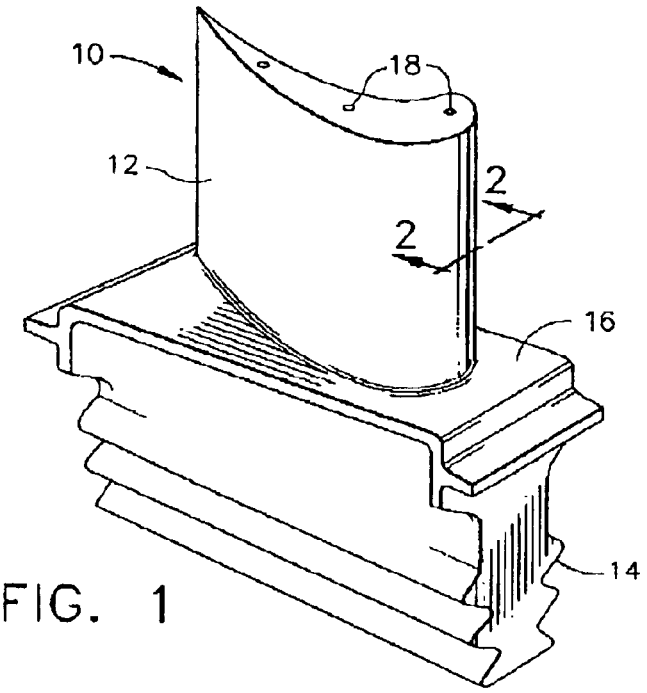
FIG. 1 is a perspective view of a high pressure turbine blade.

The present invention is generally applicable to components subjected to high temperatures, and particularly to components such as the high and low pressure turbine nozzles and blades, shrouds, combustor liners and augmentor hardware of gas turbine engines. An example of a high pressure turbine blade 10 is shown in FIG. 1. The blade 10 generally includes an airfoil 12 against which hot combustion gases are directed during operation of the gas turbine engine, and whose surface is therefore subjected to hot combustion gases as well as attack by oxidation, corrosion and erosion. The airfoil 12 is protected from its hostile operating environment by a thermal barrier coating (TBC) system schematically depicted in FIG. 2. The airfoil 12 is anchored to a turbine disk (not shown) with a dovetail 14 formed on a root section 16 of the blade 10. Cooling passages 18 are present in the airfoil 12 through which bleed air is forced to transfer heat from the blade 10. While the advantages of this invention are particularly desirable for high pressure turbine blades of the type shown in FIG. 1, the teachings of this invention are generally applicable to any component on which a thermal barrier coating may be used to protect the component from a high temperature environment.

Figure 2:
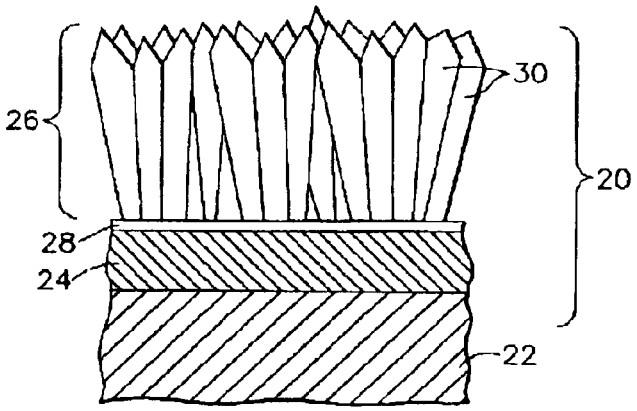
FIG. 2 schematically represents a cross-sectional view of the blade of FIG. 1 along line 2—2, and shows a thermal barrier coating system on the blade in accordance with a preferred embodiment of the invention.

The TBC system 20 is represented in FIG. 2 as including a metallic bond coat 24 that overlies the surface of a substrate 22, the latter of which is typically a superalloy and the base material of the blade 10. As is typical with TBC systems for components of gas turbine engines, the bond coat 24 is preferably an aluminum-rich composition, such as an overlay coating of an MCrAlX alloy or a diffusion coating such as a diffusion aluminide or a diffusion platinum aluminide of a type known in the art. Aluminum-rich bond coats of this type develop an aluminum oxide (alumina) scale 28, which is grown by oxidation of the bond coat 24. The alumina scale 28 chemically bonds a TBC 26, formed of a thermal-insulating material, to the bond coat 24 and substrate 22. The TBC 26 of FIG. 2 is represented as having a strain-tolerant microstructure of columnar grains 30. As known in the art, such columnar microstructures can be achieved by depositing the TBC 26 using a physical vapor deposition technique, such as EBPVD. The invention is also believed to be applicable to noncolumnar TBC deposited by such methods as plasma spraying, including air plasma spraying (APS). A TBC of this type is in the form of molten splats, resulting in a microstructure characterized by irregular flattened grains and a degree of inhomogeneity and porosity.

As with prior art TBC's, the TBC 26 of this invention is intended to be deposited to a thickness that is sufficient to provide the required thermal protection for the underlying substrate 22 and blade 10, generally on the order of about 75 to about 300 micrometers. According to the invention, the thermal-insulating material of the TBC 26 may be a two-component system of zirconia stabilized by dysprosia, gadolinium oxide, erbia, neodymia, samarium oxide or ytterbia, or a two-component system of hafnia stabilized by dysprosia, gadolinium oxide, samarium oxide, yttria or ytterbia. Three-component systems can be formed of these compositions by adding a limited amount of yttria, generally up to five weight percent, such as about 4 to about 5 weight percent. When formulated to have a cubic (fluorite-type) microstructure, each of these compositions has been shown by this invention to have a substantially lower thermal conductivity than YSZ, particular YSZ containing six to eight weight percent yttria. These compositions also have the advantage of having a relatively wide cubic region in their phase diagrams, such that impurities and inaccuracies in the coating chemistry are less likely to lead to a phase transformation. Based on an investigation discussed below, suitable, preferred and target chemistries (by atomic percent) for the TBC 26 are set forth below in Table 1. These chemistries ensure a stable cubic microstructure over the expected temperature range to which the TBC 26 would be subjected if deposited on a gas turbine engine component. [t1]

TABLE I

| Base Material | Stabilizer | Stabilizer Content (at %) Broad Range | Stabilizer Content (at %) Preferred Range |
|---|---|---|---|
| $ZrO_2$ | $Dy_2O_3$ | 10 to 45% | 10 to 30% |
| $ZrO_2$ | $Er_2O_3$ | 10 to 25% | 12 to 25% |
| $ZrO_2$ | $Gd_2O_3$ | 10 to 25% | 10 to 20% |
| $ZrO_2$ | $Nd_2O_3$ | 8 to 22% | 8 to 18% |
| $ZrO_2$ | $Sm_2O_3$ | 10 to 25% | 10 to 20% |
| $ZrO_2$ | $Yb_2O_3$ | 8 to 30% | 15 to 25% |
| $HfO_2$ | $Dy_2O_3$ | 10 to 50% | 10 to 45% |
| $HfO_2$ | $Gd_2O_3$ | 5 to 30% | 10 to 25% |
| $HfO_2$ | $Sm_2O_3$ | 5 to 30% | 10 to 20% |
| $HfO_2$ | $Y_2O_3$ | 10 to 45% | 15 to 40% |
| $HfO_2$ | $Yb_2O_3$ | 10 to 50% | 15 to 25% |

In addition to low thermal conductivities, the hafnia-based compositions of Table I have also been shown to be resistant to the infiltration of CMAS. While not wishing to be held to any particular theory, it is believed that the high melting temperature and surface energy of hafnia leads to little or no bonding tendency to the CMAS eutectic composition, and therefore inhibits the infiltration and bonding of CMAS to the TBC 26 while CMAS is molten and therefore capable of infiltrating the TBC 26. To benefit from this capability, the hafnia-based coatings of this invention can be used alone or as the outermost layer of a multilayer TBC. Even when deposited by PVD to have a columnar grain structure as shown in FIG. 2, the hafnia-based coating compositions of this invention have been observed to reject or minimize the formation and infiltration of CMAS that would otherwise result in a CTE mismatch that can lead to spallation of the TBC 26.

In an investigation leading to this invention, TBC's were deposited by EBPVD on specimens formed of the superalloy René N5 on which a PtAl diffusion bond coat had been deposited. The specimens were coated by evaporating a single ingot of the desired composition. The TBC's were deposited to have thicknesses on the order of about 75 to about 150 micrometers. The chemistries and thermal conductivities of the coatings are summarized in Table II below. Thermal conductivities are reported at about 890° C. following both stabilization at about 1000° C. and a thermal aging treatment in which the specimens were held at about 1200° C. for about two hours to determine the thermal stability of their coatings.
[t3]

TABLE II

| | Specimen (Coating) | Stabilizer Content (at. %) | Stabilizer Content (wt. %) | Thermal Conductivity Stabilized (W/mK) | Thermal Conductivity Aged (W/mK) |
|---|---|---|---|---|---|
| | $ZrO_2 + Dy_2O_3$ | 15 | 34.8 | 1.13 | 1.19 |
| | $ZrO_2 + Er_2O_3$ | 17 | 38.9 | 1.14 | 1.13 |
| a | $ZrO_2 + Gd_2O_3$ | 19.6 | 41.0 | 0.95 | 1.21 |
| b | $ZrO_2 + Gd_3 3O_3$ | 14.3 | 32.0 | 0.96 | 1.20 |
| | $ZrO_2 + Nd_2O_3$ | 13 | 29.0 | 0.95 | 1.14 |
| | $ZrO_2 + Sm_2O_3$ | 15 | 33.3 | n/a | n/a |
| | $ZrO_2 + Yb_2O_3$ | 20 | 44.4 | 1.16 | 1.16 |
| | $ZrO_2 + Yb_2O_3$ | 20 | 44.4 | 1.11 | 1.17 |
| c | $ZrO_2 + Yb_2O_3$ | 19.5 | 43.0 | 0.95 | 1.03 |
| d | $ZrO_2 + Yb_2O_3$ | 18.9 | 42.0 | 1.09 | 1.17 |
| | $HfO_2 + Dy_2O_3$ | 30 | 43.2 | 0.84 | 0.96 |
| | $HfO_2 + Gd_2O_3$ | 15 | 23.3 | 0.96 | 1.13 |
| | $HfO_2 + Sm_2O_3$ | 20 | 29.3 | n/a | n/a |
| | $HfO_2 + Y_2O_3$ | 30 | 31.5 | n/a | n/a |
| | $HfO_2 + Yb_2O_3$ | 20 | 31.9 | 1.16 | 1.16 |

a Further alloyed to contain 4 wt. % $Y_2O_3$ (about 3.1 at. %).
b Further alloyed to contain 4.8 wt. % $Y_2O_3$ (about 3.4 at. %).
c Further alloyed to contain 4 wt. % $Y_2O_3$ (about 3.2 at. %).
d Further alloyed to contain 4.1 wt. % $Y_2O_3$ (about 3.2 at. %).

The above results evidenced that the zirconia and hafnia-based TBC coatings of this invention had much lower thermal conductivities than the industry standard 6–8% YSZ material (above about 1.6 W/mK), and are significantly more thermally stable than 7% YSZ in terms of the thermal conductivities. Based on these results, it is also believed that the thermal conductivities of the zirconia and hafnia-based compositions of this invention might be further reduced by the inclusion of third and/or fourth oxides. Suitable oxides for this purpose include those evaluated above, namely, dysprosia, gadolinium oxide, erbia, neodymia, samarium oxide and ytterbia, as well as potentially zirconia (for the hafnium-based compositions), hafnia (for the zirconia-based compositions), barium oxide (BaO), calcia (CaO), ceria ($CeO_2$), europia ($Eu_2O_3$), indium oxide ($In_2O_3$), lanthana ($La_2O_3$), magnesia (MgO), niobia ($Nb_2O_5$), praseodymia ($Pr_2O_3$), scandia ($Sc_2O_3$), strontia (SrO), tantala ($Ta_2O_3$), titania ($TiO_2$) and thulia ($Tm_2O_3$).

While the invention has been described in terms of a preferred embodiment, it is apparent that other forms could be adopted by one skilled in the art. Accordingly, the scope of the invention is to be limited only by the following claims.

What is claimed is:

1. A component comprising an outer coating having a fluorite cubic microstructure and consisting essentially of either a zirconia-based composition or a hafnia-based composition, the zirconia-based composition consisting of zirconia and a stabilizer chosen from the group consisting of erbia, neodymia, and samarium oxide, the hafnia-based composition consisting essentially of hafnia and at least one stabilizer chosen from the group consisting of dysprosia, gadolinium oxide, samarium oxide, and ytterbia and optionally a second stabilizer consisting of yttria.

2. A component according to claim 1, wherein the outer coating consists of one of the zirconia-based compositions.

3. A component according to claim 1, wherein the outer coating consists of zirconia stabilized by about 10 to about 25 atomic percent erbia.

4. A component according to claim 1, wherein the outer coating consists of zirconia stabilized by about 8 to about 22 atomic percent neodymia.

5. A component according to claim 1, wherein the outer coating consists of zirconia stabilized by about 10 to about 25 atomic percent samarium oxide.

6. A component according to claim 1, wherein the outer coating consists of one of the hafhia-based compositions.

7. A component according to claim 1, wherein the outer coating consists of hafnia stabilized by about 10 to about 50 atomic percent dysprosia.

8. A component according to claim 1, wherein the outer coating consists of hafnia stabilized by about 5 to about 30 atomic percent gadolinium oxide.

9. A component according to claim 1, wherein the outer coating consists of hafnia stabilized by about 5 to about 30 atomic percent samarium oxide.

10. A component according to claim 1, wherein the outer coating consists of the hafnia-based composition and contains about 4 to about 5 weight percent yttria.

11. A component according to claim 1, wherein the outer coating consists of hafnia stabilized by about 10 to about 50 atomic percent ytterbia.

12. A component according to claim 1, wherein the outer coating consists of hafnia, either gadolinium oxide or ytterbia as the stabilizer, and about 4 to about 5 weight percent yttria.

13. A component according to claim 1, further comprising a metallic bond coat adhering the outer coating to the component.

14. A component according to claim 1, wherein the component is a superalloy airfoil component of a gas turbine engine.

15. A gas turbine engine component comprising:

a superalloy substrate;

a metallic bond coat on a surface of the substrate; and a thermal barrier layer as an outermost coating of the component, the thermal barrier layer having columnar grains and a fluorite cubic microstructure, the thermal barrier layer consisting of either a stabilized zirconia-based composition or a stabilized hafnia-based composition;

wherein the stabilized zirconia-based composition is chosen from the group consisting of zirconia stabilized with about 10 to about 25 atomic percent erbia, zirconia stabilized with about 8 to about 22 atomic percent neodymia, and zirconia stabilized with about 10 to about 25 atomic percent samarium oxide; and wherein the stabilized hafnia-based composition is chosen from the group consisting of hafnia stabilized with about 10 to about 50 atomic percent dysprosia, hafhia stabilized with about 5 to about 30 atomic percent gadolinium oxide, hafnia stabilized with about 5 to about 30 atomic percent samarium oxide, or hafnia stabilized with about 10 to about 50 atomic percent ytterbia.

16. A gas turbine engine component according to claim 15, wherein the thermal barrier layer consists of zirconia stabilized by about 12 to about 25 atomic percent erbia.

17. A gas turbine engine component according to claim 15, wherein the thermal barrier layer consists of zirconia stabilized by about 8 to about 18 atomic percent neodymia.

18. A gas turbine engine component according to claim 15, wherein the thermal barrier layer consists of zirconia stabilized by about 10 to about 20 atomic percent samarium oxide.

19. A gas turbine engine component according to claim 15, wherein the thermal barrier layer consists of hafnia stabilized by about 10 to about 45 atomic percent dysprosia.

20. A gas turbine engine component according to claim 15, wherein the thermal barrier layer consists of hafnia stabilized by about 10 to about 25 atomic percent gadolinium oxide.

21. A gas turbine engine component according to claim 15, wherein the thermal barrier layer consists of hafnia stabilized by about 10 to about 20 atomic percent samarium oxide.

22. A gas turbine engine component according to claim 15, wherein the outer coating consists of the hafnia-based composition and contains about 4 to about 5 weight percent yttria.

23. A gas turbine engine component according to claim 15, wherein the thermal barrier layer consists of hafnia stabilized by about 15 to about 25 atomic percent ytterbia.

* * * * *